US010886615B2

(12) United States Patent
Gallagher et al.

(10) Patent No.: US 10,886,615 B2
(45) Date of Patent: Jan. 5, 2021

(54) INTERLEAVED MULTI-BAND ANTENNA ARRAYS

(71) Applicant: Maxlinear, Inc., Carlsbad, CA (US)

(72) Inventors: Timothy Gallagher, Carlsbad, CA (US); Curtis Ling, Carlsbad, CA (US)

(73) Assignee: MaxLinear, Inc., Carlsbad, CA (US)

( * ) Notice: Subject to any disclaimer, the term of this patent is extended or adjusted under 35 U.S.C. 154(b) by 789 days.

(21) Appl. No.: 15/238,862

(22) Filed: Aug. 17, 2016

(65) Prior Publication Data

US 2017/0054211 A1 Feb. 23, 2017

Related U.S. Application Data

(60) Provisional application No. 62/206,377, filed on Aug. 18, 2015.

(51) Int. Cl.

*H01Q 5/42* (2015.01)
*H01Q 21/06* (2006.01)
*H01Q 21/00* (2006.01)

(52) U.S. Cl.

CPC ..... *H01Q 5/42* (2015.01); *H01Q 21/064* (2013.01); *H01Q 21/065* (2013.01); *H01Q 21/0025* (2013.01)

(58) Field of Classification Search

CPC ..... H01Q 21/0025; H01Q 21/0006; H01Q 21/064; H01Q 21/22; H01Q 21/06; H01Q 5/42

See application file for complete search history.

(56) References Cited

U.S. PATENT DOCUMENTS 5,434,580 A * 7/1995 Raguenet ..... H01Q 5/42 343/700 MS
5,838,282 A * 11/1998 Lalezari ..... H01Q 21/26 343/727
6,175,333 B1 * 1/2001 Smith ..... H01Q 1/38 343/700 MS
6,404,404 B1 * 6/2002 Chen ..... H01Q 21/0025 343/844
6,529,166 B2 * 3/2003 Kanamaluru ..... H01Q 25/00 343/700 MS
6,795,020 B2 * 9/2004 Sreenivas ..... H01Q 1/38 343/700 MS
7,075,485 B2 * 7/2006 Song ..... H01Q 1/246 343/700 MS
2009/0058754 A1 * 3/2009 Webb ..... H01Q 3/26 343/850
2009/0066598 A1 * 3/2009 Malstrom ..... H01Q 13/02 343/786

(Continued)

*Primary Examiner* — Ab Salam Alkassim, Jr.
(74) *Attorney, Agent, or Firm* — Maschoff Brennan

(57) ABSTRACT

Aspects of methods and systems for interleaved multi-band antenna arrays are provided. An array based communications system may comprise element processors and antenna elements. Each element processor of a first plurality of element processors may communicate in a first communication band via an antenna element in a first antenna array. Each element processor of a second plurality of element processors may communicate in a second communication band via an antenna element in a second antenna array. One or more antenna elements of the second antenna array may be positioned between antenna elements of the first antenna array.

7 Claims, 11 Drawing Sheets

(56) References Cited

U.S. PATENT DOCUMENTS

| | | | | |
|---|---|---|---|---|
| 2009/0284440 | A1* | 11/2009 | Weidmann | H01Q 21/061 343/893 |
| 2009/0303125 | A1* | 12/2009 | Caille | H01Q 3/26 342/368 |
| 2010/0149061 | A1* | 6/2010 | Haziza | H01Q 13/0233 343/779 |
| 2012/0119952 | A1* | 5/2012 | Pozgay | H01Q 3/01 342/372 |
| 2014/0203995 | A1* | 7/2014 | Romney | H01Q 19/17 343/893 |
| 2014/0375518 | A1* | 12/2014 | Powell | H01Q 9/16 343/816 |
| 2015/0188236 | A1* | 7/2015 | Oppenlaender | H01Q 13/02 343/776 |
| 2015/0222021 | A1* | 8/2015 | Stevenson | H01Q 13/18 343/771 |
| 2015/0318622 | A1* | 11/2015 | Pruett | H01Q 21/061 343/876 |
| 2016/0233588 | A1* | 8/2016 | Bily | H01Q 25/00 |
| 2017/0149147 | A1* | 5/2017 | Minami | H01Q 21/29 |

* cited by examiner

INTERLEAVED MULTI-BAND ANTENNA ARRAYS

CROSS-REFERENCE TO RELATED APPLICATIONS/INCORPORATION BY REFERENCE

This patent application makes reference to, claims priority to, and claims the benefit from U.S. Provisional Application Ser. No. 62/206,377, which was filed on Aug. 18, 2015. The above application is hereby incorporated herein by reference in its entirety.

BACKGROUND

Limitations and disadvantages of conventional methods and systems for communication systems will become apparent to one of skill in the art, through comparison of such systems with some aspects of the present invention as set forth in the remainder of the present application with reference to the drawings.

BRIEF SUMMARY OF THE INVENTION

Systems and methods are provided for interleaved multi-band antenna arrays, substantially as shown in and/or described in connection with at least one of the figures, as set forth more completely in the claims.

Advantages, aspects and novel features of the present disclosure, as well as details of an illustrated embodiment thereof, will be more fully understood from the following description and drawings.

DETAILED DESCRIPTION OF THE INVENTION

Figure 1A:
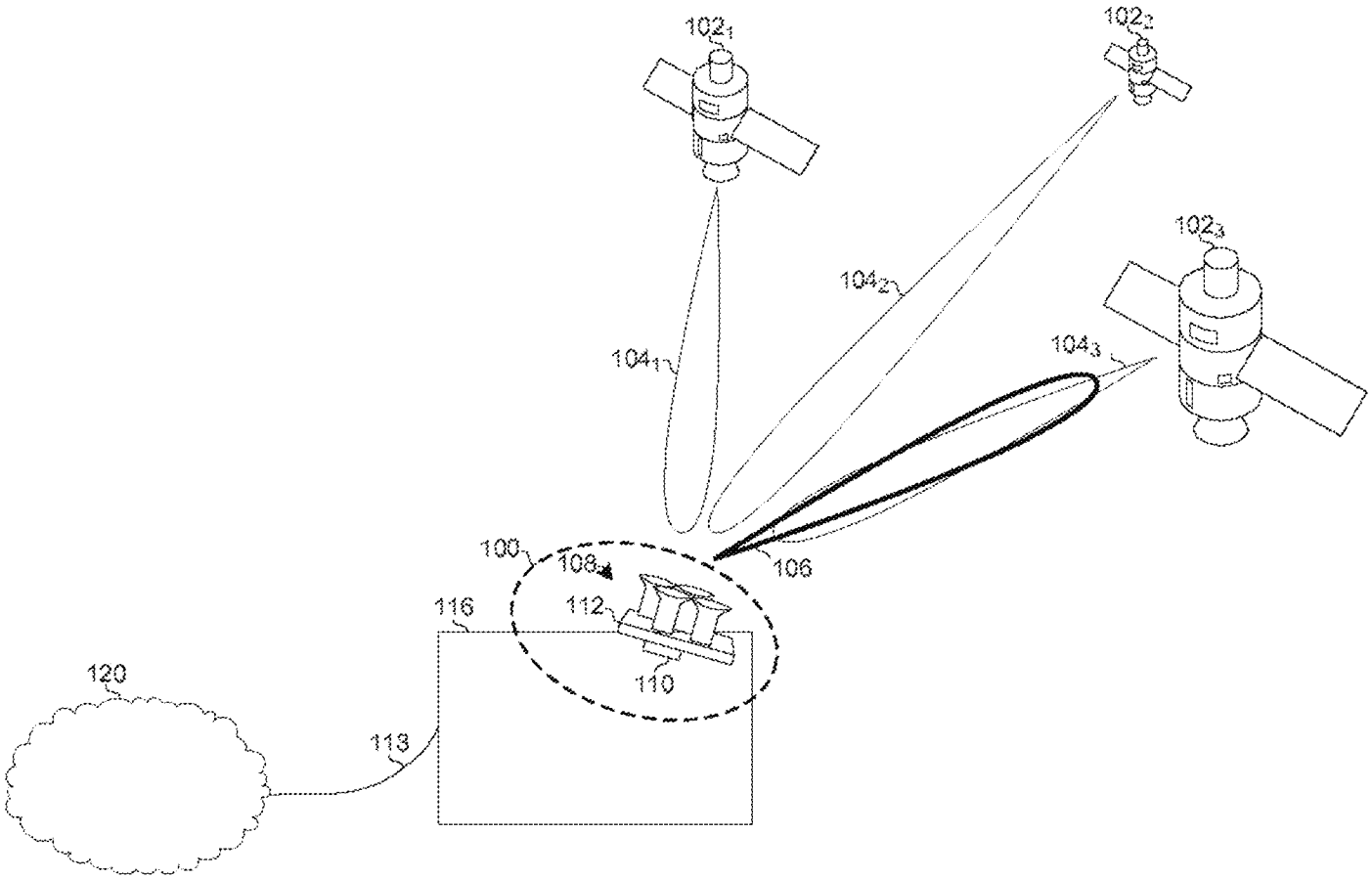
FIG. 1A shows a single-unit-cell transceiver array communicating with a plurality of satellites.

FIG. 1A shows a single-unit-cell transceiver array communicating with a plurality of satellites. Shown in FIG. 1A is a device 116 comprising a transceiver array 100 operable to communicate with a plurality of satellites 102. The device 116 may, for example, be a phone, laptop computer, or other mobile device. The device 116 may, for example, be a desktop computer, server, or other stationary device. In the latter case, the transceiver array 100 may be mounted remotely from the housing of the device 116 (e.g., via fiber optic cables). Device 118 is also connected to a network (e.g., LAN and/or WAN) via a link 118.

Figure 2A:
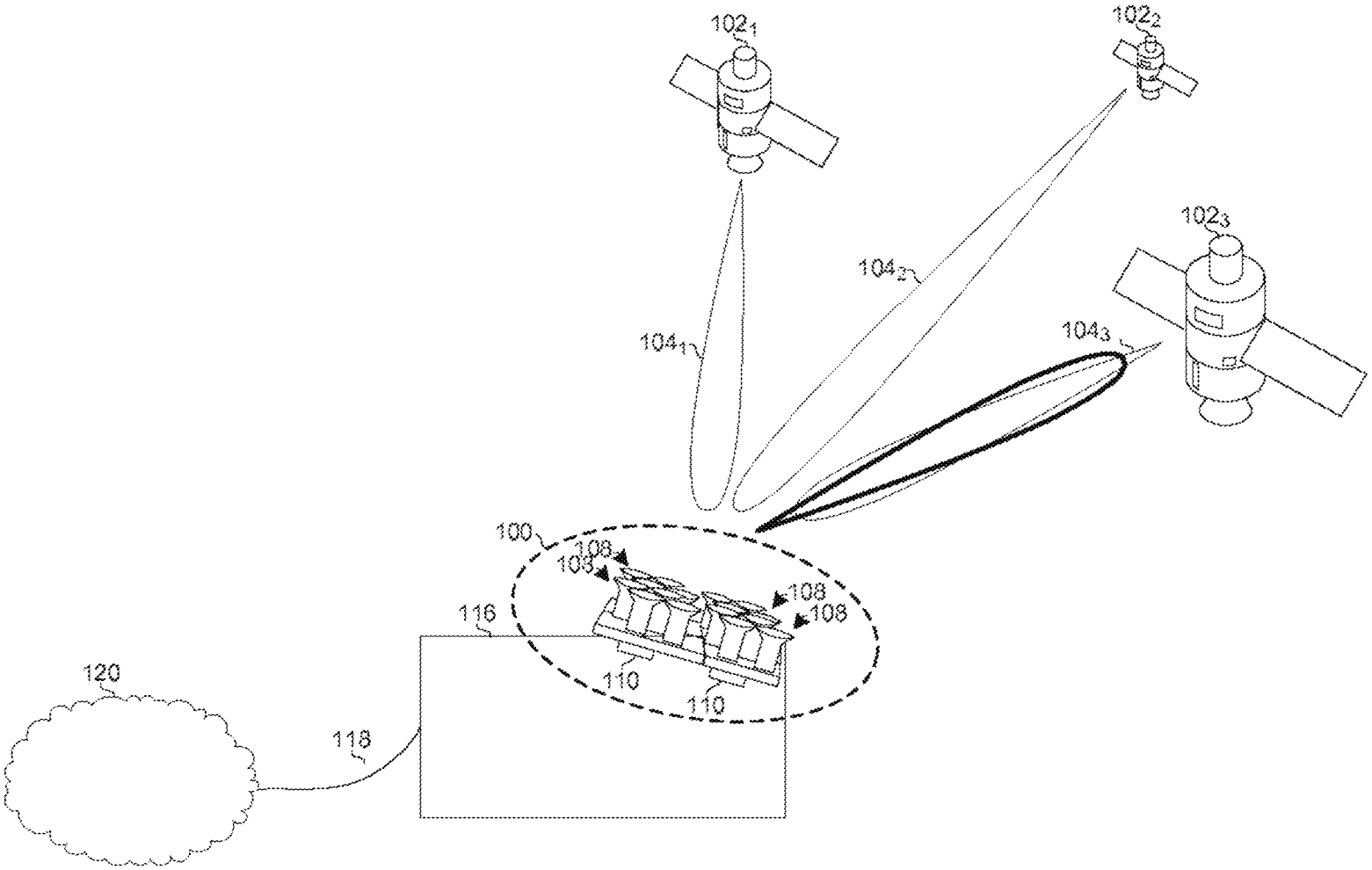
FIG. 2A shows a transceiver which comprises a plurality of the unit cells of FIG. 1B and is communicating with a plurality of satellites.

In an example implementation, the satellites 102 shown in FIGS. 1A and 2A are just a few of hundreds, or even thousands, of satellites having a faster-than-geosynchronous orbit. For example, the satellites may be at an altitude of approximately 1100 km and have an orbit periodicity of around 100 minutes.

Figure 3:
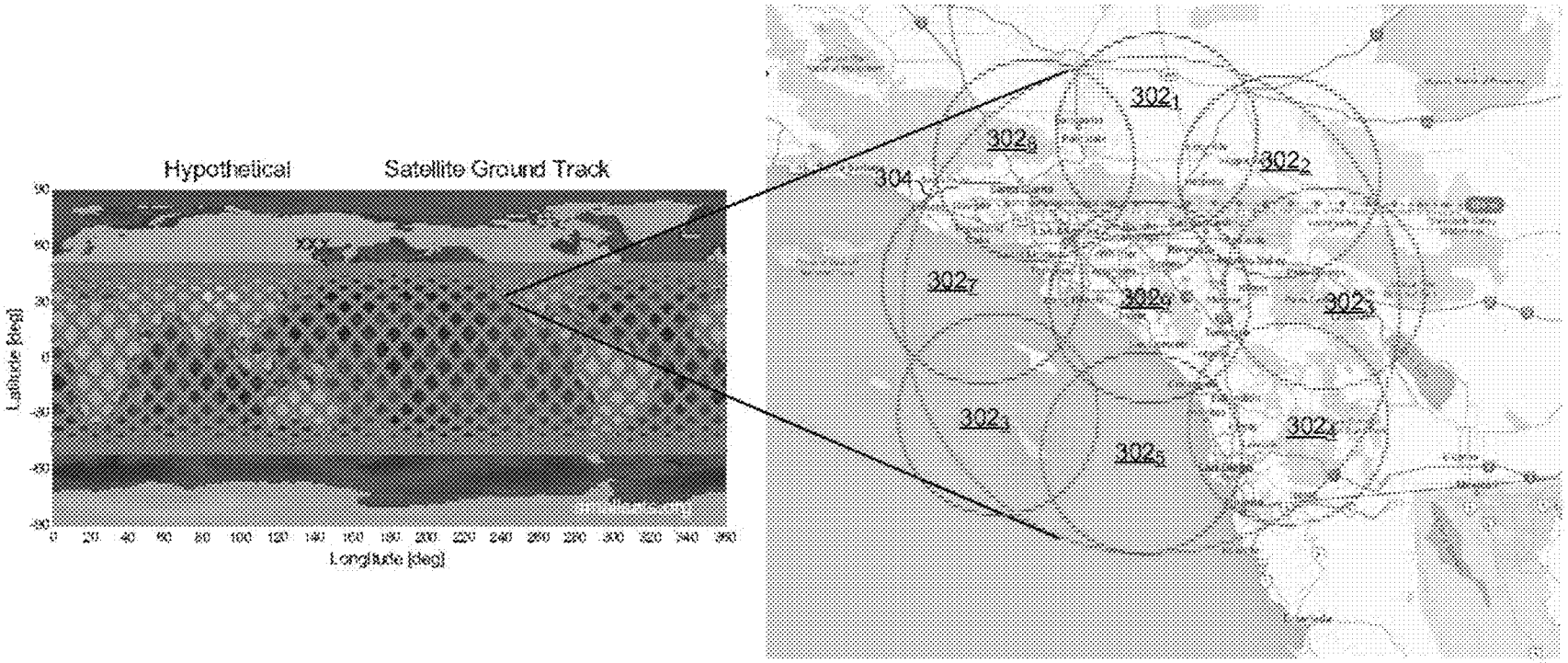
FIG. 3 shows a hypothetical ground track of a satellite system in accordance with aspects of this disclosure.

Each of the satellites 102 may, for example, be required to cover 18 degrees viewed from the Earth's surface, which may correspond to a ground spot size per satellite of ~150 km radius. To cover this area (e.g., area 304 of FIG. 3), each satellite 102 may comprise a plurality of antenna elements generating multiple spot beams (e.g., the nine spot beams 302 of FIG. 3). In an example implementation, each of the satellites 102 may comprise one or more transceiver array, such as the transceiver array 100 described herein, operable to implement aspects of this disclosure. This may enable steering the coverage area of the spot beams without having to mechanically steer anything on the satellite 102. For example, when a satellite 102 is over a sparsely populated area (e.g., the ocean) but approaching a densely populated area (e.g., Los Angeles), the beams of the satellite 102 may be steered ahead such that they linger on the sparsely populated area for less time and on the densely populated area for more time, thus providing more throughput where it is needed.

Figure 1B:
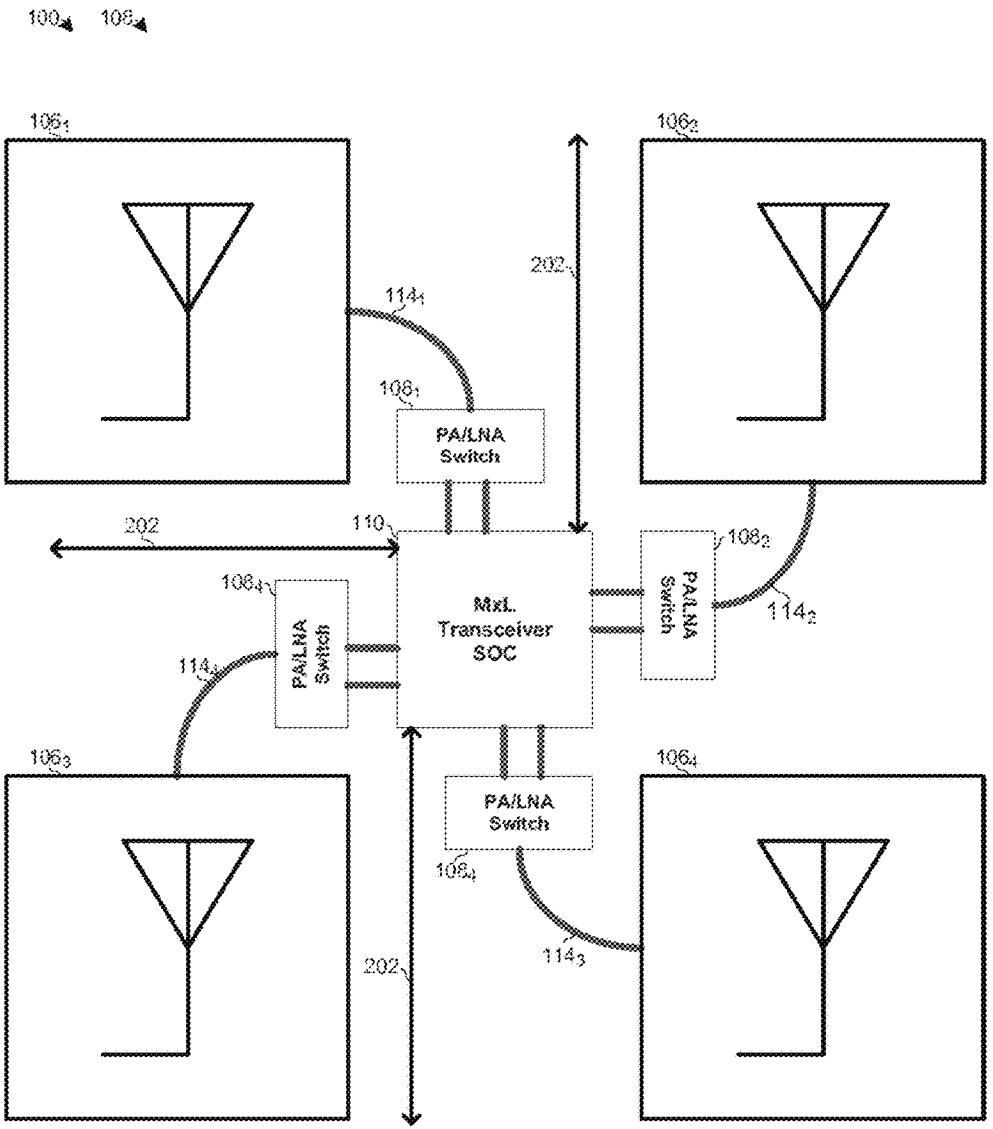
FIG. 1B shows details of an example implementation of the single-unit-cell transceiver array of FIG. 1A.
Figure 2B:
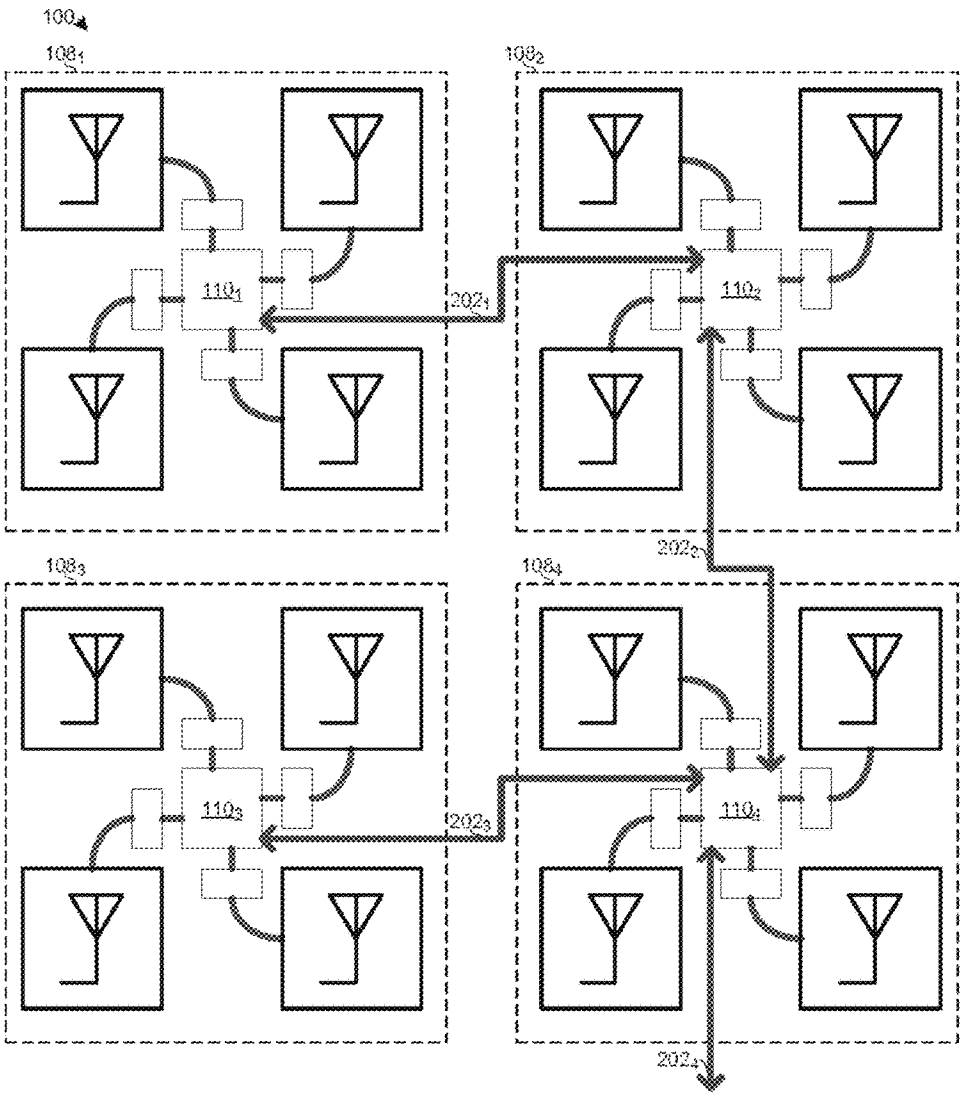
FIG. 2B shows details of an example implementation of the transceiver of FIG. 1A.
Figure 4:
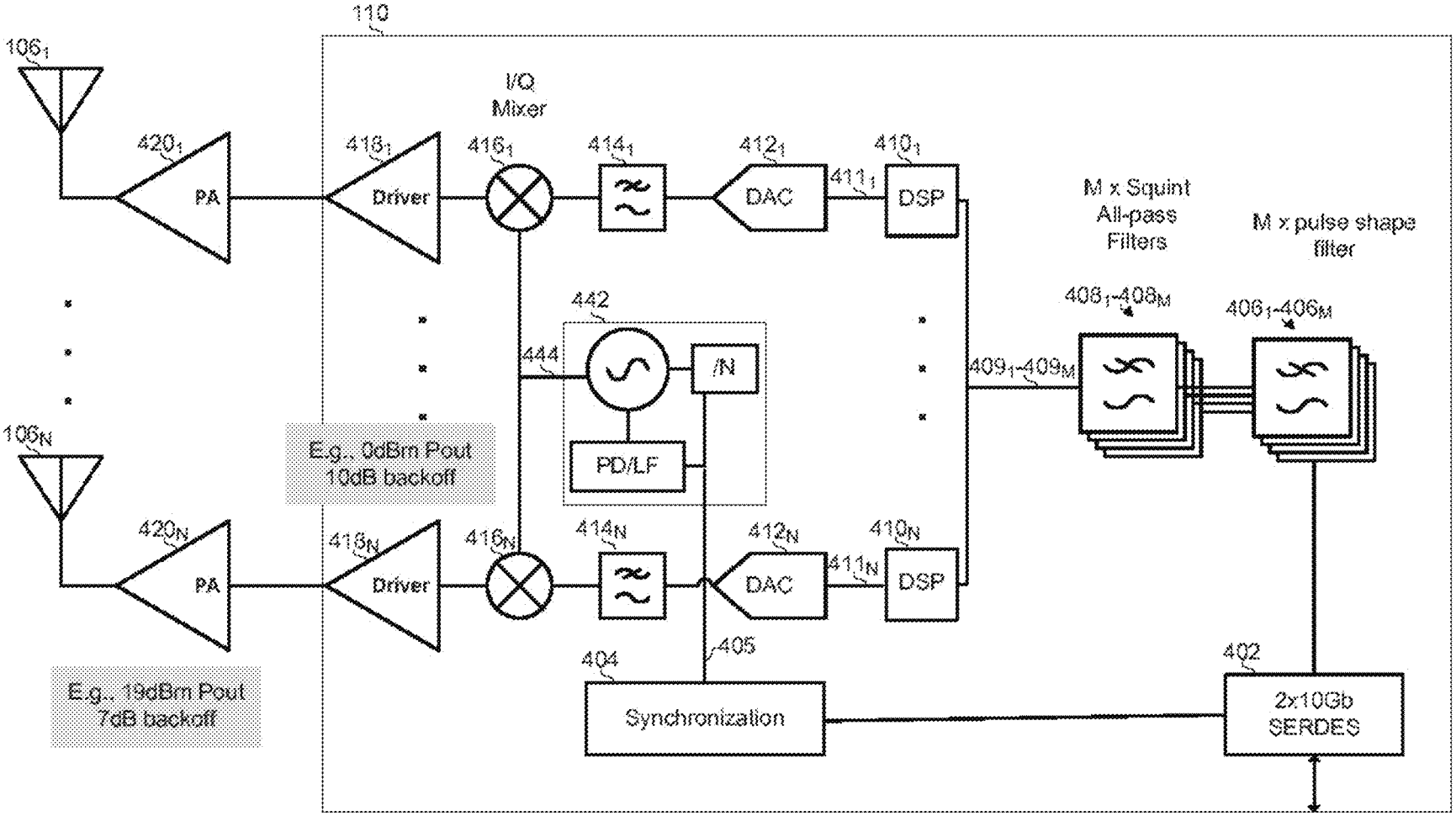
FIG. 4 depicts transmit circuitry of an example implementation of the unit cell of FIG. 1B.

As shown in FIG. 1B, an example unit cell 108 of a transceiver array 100 comprises a plurality of antenna elements 106 (e.g., four antenna elements per unit cell 108 in the examples of FIGS. 1B and 2B; and 'N' per unit cell in the example of FIG. 4), a transceiver circuit 110, and, for a time-division-duplexing (TDD) implementation, a plurality of transmit/receive switches 108. The respective power amplifiers (PAs) for each of the four antenna elements $\mathbf{106}_1$-$\mathbf{106}_4$ are not shown explicitly in FIG. 1B but may, for example, be integrated on the circuit 110 or may reside on a dedicated chip or subassembly (as shown, for example, in FIG. 4, below). The antenna elements 106, circuit 110, and circuit 108 may be mounted to a printed circuit board (PCB) 112 (or other substrate). The components shown in FIG. 1B are referred to herein as a "unit cell" because multiple instances of this unit cell 108 may be ganged together to form a larger transceiver array 100. In this manner, the architecture of a transceiver array 100 in accordance with various implementations of this disclosure may be modular and scalable. FIGS. 2A and 2B, for example, illustrate an implementation in which four unit cells 108, each having four antenna elements 106 and a transceiver circuit 110, have been ganged together to form a transceiver array 100 comprising sixteen antenna elements 106 and four transceiver circuits 110. The various unit cells 108 are coupled via lines 202 which, in an example implementation represent one or more data busses (e.g., high-speed serial busses similar to what is used in backplane applications) and/or one or more clock distribution traces (which may be referred to as a "clock tree"), as described below with reference to FIGS. 5A, 5B, 6A, and 6B.

Use of an array of antenna elements 106 enables beamforming for generating a radiation pattern having one or more high-gain beams. In general, any number of transmit and/or receive beams are supported.

In an example implementation, each of the antenna elements 106 of a unit cell 108 is a horn mounted to a printed circuit board (PCB) 112 with waveguide feed lines 114. The circuit 110 may be mounted to the same PCB 112. In this manner, the feed lines 114 to the antenna elements may be kept extremely short. For example, the entire unit cell 108 may be, for example, 6 cm by 6 cm such that length of the feed lines 114 may be on the order of centimeters. The horns may, for example, be made of molded plastic with a metallic coating such that they are very inexpensive. In another example implementation, the antenna elements 106 may be, for example, stripline or microstrip patch antennas.

The ability of the transceiver array 100 to use beamforming to simultaneously receive from multiple of the satellites 102 may enable soft handoffs of the transceiver array 110 between satellites 102. Soft handoff may reduce downtime as the transceiver array 100 switches from one satellite 102 to the next. This may be important because the satellites 102 may be orbiting at speeds such that any particular satellite 102 only covers the transceiver array 100 for on the order of 1 minute, thus resulting in very frequent handoffs. For example, satellite $\mathbf{102}_3$ may be currently providing primary coverage to the transceiver array 100 and satellite $\mathbf{102}_1$ may be the next satellite to come into view after satellite $\mathbf{102}_3$. The transceiver array 100 may be receiving data via beam $\mathbf{104}_3$ and transmitting data via beam 106 while, at the same time, receiving control information (e.g., a low data rate beacon comprising a satellite identifier) from satellite $\mathbf{102}_1$ via beam $\mathbf{104}_1$. The transceiver array 100 may use this control information for synchronizing circuitry, adjusting beamforming coefficients, etc., in preparation for being handed-off to satellite $\mathbf{102}_1$. The satellite to which the transceiver array 100 is transmitting may relay messages (e.g., ACKs or retransmit requests) to the other satellites from which transceiver array 100 is receiving.

FIG. 4 depicts transmit circuitry of an example implementation of the unit cell of FIG. 1B. In the example implementation shown, circuit 110 comprises a SERDES interface circuit 402, synchronization circuit 404, local oscillator generator 442, pulse shaping filters $\mathbf{406}_1$-$\mathbf{406}_M$ (M being an integer greater than or equal to 1), squint filters $\mathbf{408}_1$-$\mathbf{408}_M$, per-element digital signal processing circuits $\mathbf{410}_1$-$\mathbf{410}_N$, DACs $\mathbf{412}_1$-$\mathbf{412}_N$, filters $\mathbf{414}_1$-$\mathbf{414}_N$, mixers $\mathbf{416}_1$-$\mathbf{416}_N$, and drivers $\mathbf{418}_1$-$\mathbf{418}_N$. The outputs of the PA drivers $\mathbf{418}_1$-$\mathbf{418}_N$ are amplified by PAs $\mathbf{420}_1$-$\mathbf{420}_N$ before being transmitted via antenna elements $\mathbf{106}_1$-$\mathbf{106}_N$.

The SERDES interface circuit 402 is operable to exchange data with other instance(s) of the circuit 110 and other circuitry (e.g., a CPU) of the device 116.

The synchronization circuit 404 is operable to aid synchronization of a reference clock of the circuit 110 with the reference clocks of other instance(s) of the circuit 110 of the transceiver array 100.

The local oscillator generator 442 is operable to generate one or more local oscillator signals 444 based on the reference signal 405.

The pulse shaping filters $\mathbf{406}_1$-$\mathbf{406}_M$ (M being an integer greater than or equal to 1) are operable to receive bits to be transmitted from the SERDES interface circuit 402 and shape the bits before conveying them to the M squint processing filters $\mathbf{408}_1$-$\mathbf{408}_M$. In an example implementation, each pulse shaping filter $\mathbf{406}_m$ processes a respective one of M datastreams from the SERDES interface circuit 402.

Each of the squint filters $\mathbf{408}_1$-$\mathbf{408}_M$ is operable to compensate for squint effects which may result from bandwidth of the signals $\mathbf{409}_1$-$\mathbf{409}_M$ being wide relative to the center frequency.

Each of the per-element digital signal processing circuits $\mathbf{410}_1$-$\mathbf{410}_N$ is operable to perform processing on the signals $\mathbf{409}_1$-$\mathbf{409}_M$. Each one of the circuits $\mathbf{410}_1$-$\mathbf{410}_N$ may be configured independently of each of the other ones of the circuits $\mathbf{410}_1$-$\mathbf{410}_N$ such that each one of the signals $\mathbf{411}_1$-$\mathbf{411}_N$ may be processed as necessary/desired without impacting the other ones of the signals $\mathbf{411}_1$-$\mathbf{411}_N$.

Each of the DACs $\mathbf{412}_1$-$\mathbf{412}_N$ is operable to convert a respective one of the digital signals $\mathbf{411}_1$-$\mathbf{411}_N$ to an analog signal. Each of the filters $\mathbf{414}_1$-$\mathbf{414}_N$ is operable to filter (e.g., anti-alias filtering) the output of a respective one of the DACs $\mathbf{412}_1$-$\mathbf{412}_N$. Each of the mixers $\mathbf{416}_1$-$\mathbf{416}_N$ is operable to mix an output of a respective one of the filters $\mathbf{414}_1$-$\mathbf{414}_N$ with the local oscillator signal 444. Each of the PA drivers $\mathbf{418}_1$-$\mathbf{418}_N$ conditions an output of a respective one of the mixers $\mathbf{416}_1$-$\mathbf{416}_N$ for output to a respective one of PAs $\mathbf{420}_1$-$\mathbf{420}_N$. In a non-limiting example, each PA driver $\mathbf{418}_n$ (n being an integer between 1 and N) is operated at 10 dB from its saturation point and outputs a 0 dBm signal. In a non-limiting example, each PA $\mathbf{420}_n$ is operated at 7 dB from its saturation point and outputs a 19 dBm signal.

In an example implementation antenna elements of a second antenna array may be interleaved with antenna elements of the first array. For example, the first array may comprise antenna elements that transmit or receive a first frequency band (or set of frequency bands) more efficiently than a second frequency band (or set of bands), and the second array may comprise elements transmit or receiver the second frequency band (or bands) more efficiently than the first band(s). For satellite communications, for example, the first antenna array may be more efficient for Ka band signals and the second antenna array may be more efficient for Ku band signals.

Figure 5A:
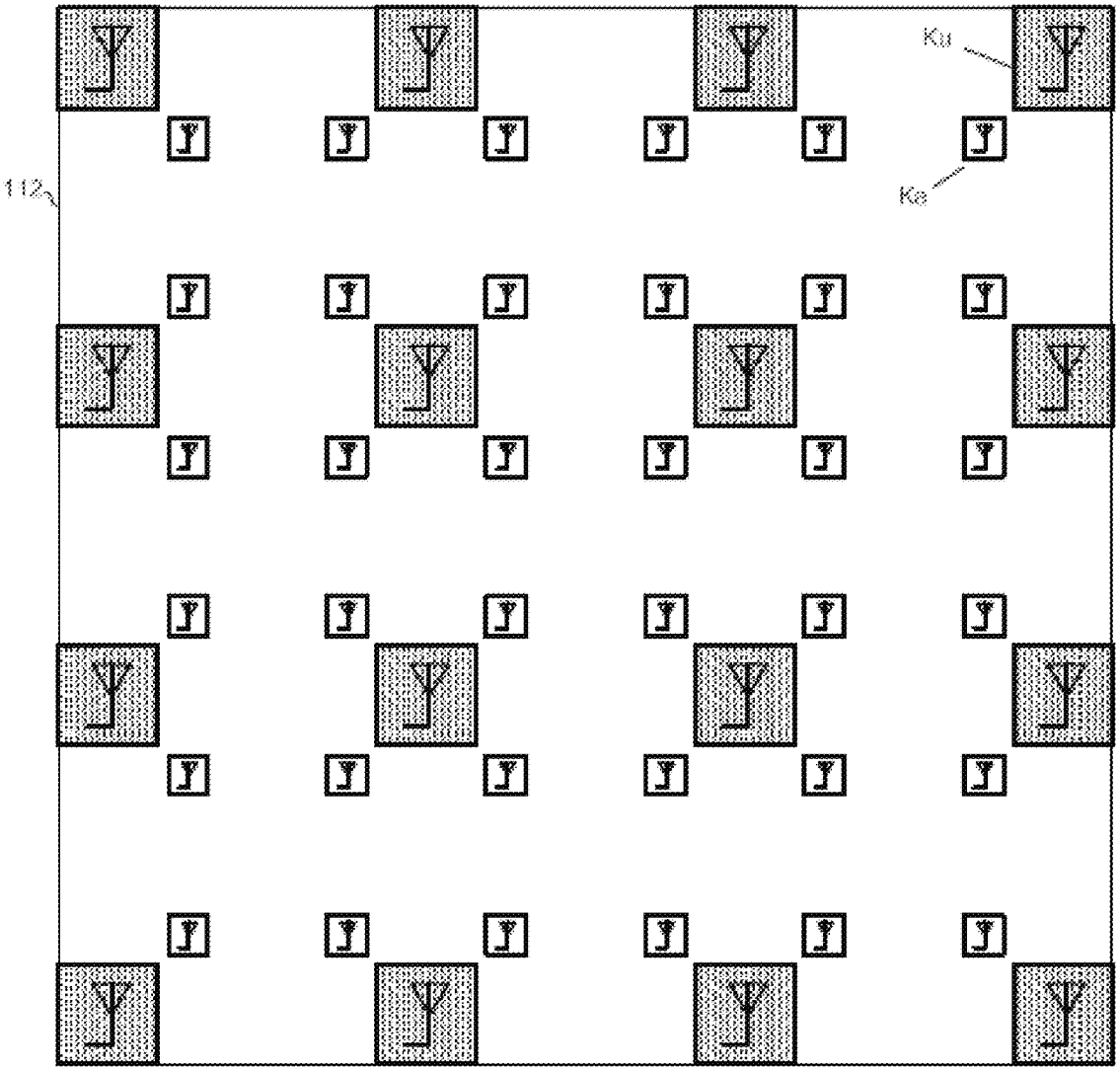
FIG. 5A illustrates one example of how antenna elements of a Ka band array may be interleaved with elements of a Ku band array.

FIG. 5A illustrates one example of how antenna elements of a Ka band array may be interleaved with elements of a Ku band array.

Figure 5B:
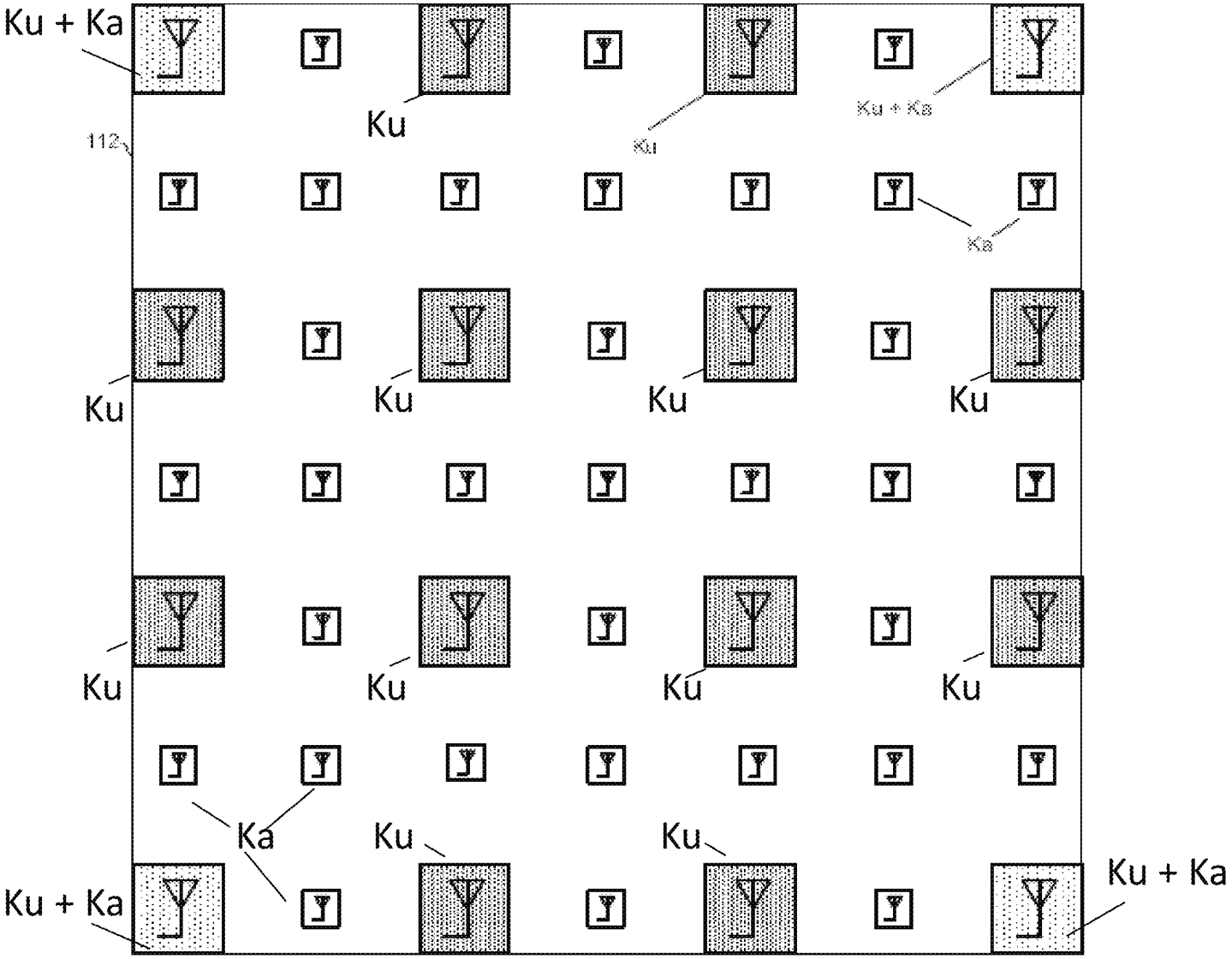
FIG. 5B illustrates another example of how antenna elements of a Ka band array may be interleaved with elements of a Ku band array.
Figure 5C:
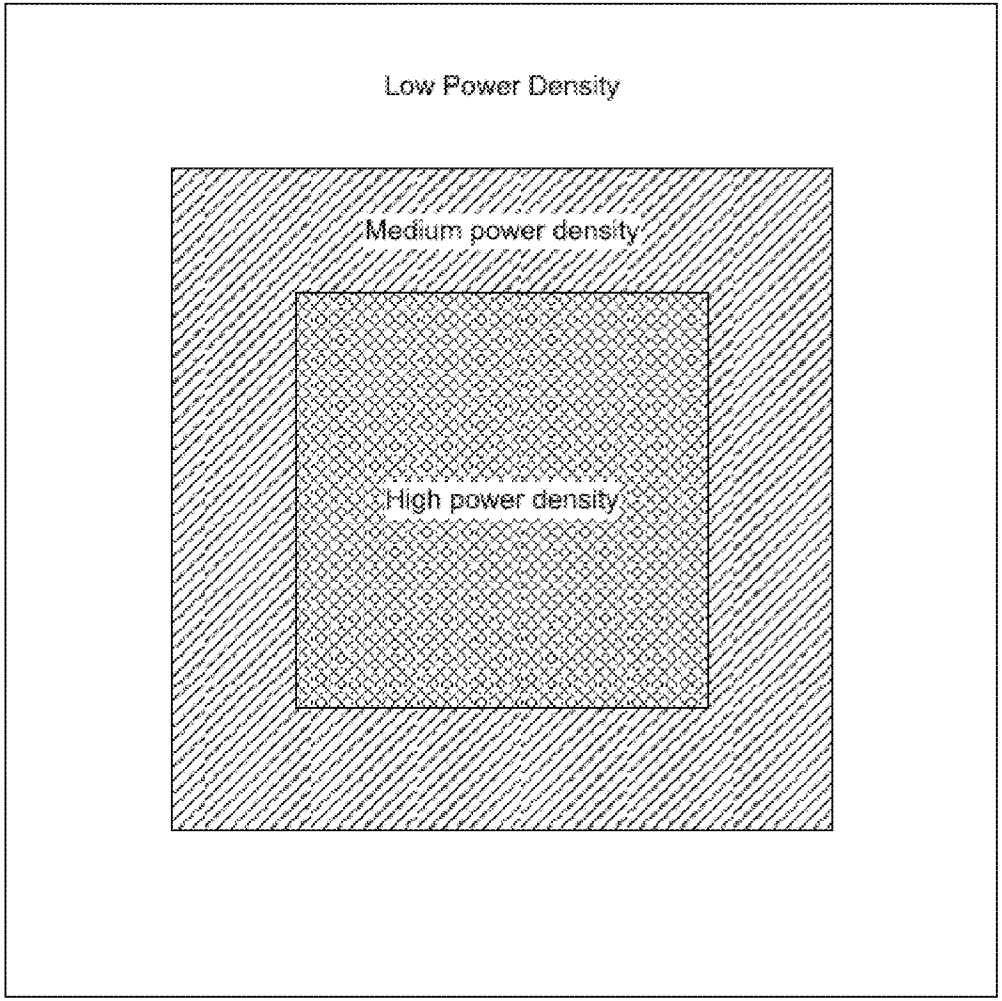
FIG. 5C illustrates an example power density profile of an antenna array.

FIG. 5B illustrates another example of how antenna elements of a Ka band array may be interleaved with elements of a Ku band array. FIG. 5B also illustrates that some elements may be part of both antenna arrays. These elements may be slight less efficient for both the first and second band(s), but that may be acceptable in some instances. For example, as shown in FIG. 5C, the power delivered to an antenna array is generally profiled so that it tapers off toward the edges. This may be done to reduce undesired side lobes. Thus antenna elements at the edge of an array are driven with relatively low power. Consequently, efficiency of antenna elements that are closer to the edge is not as important as for elements closer of the center of the array. Accordingly, as shown in FIG. 5B, the less efficient elements which are part of both antenna arrays may be located near the edges.

Figure 5D:
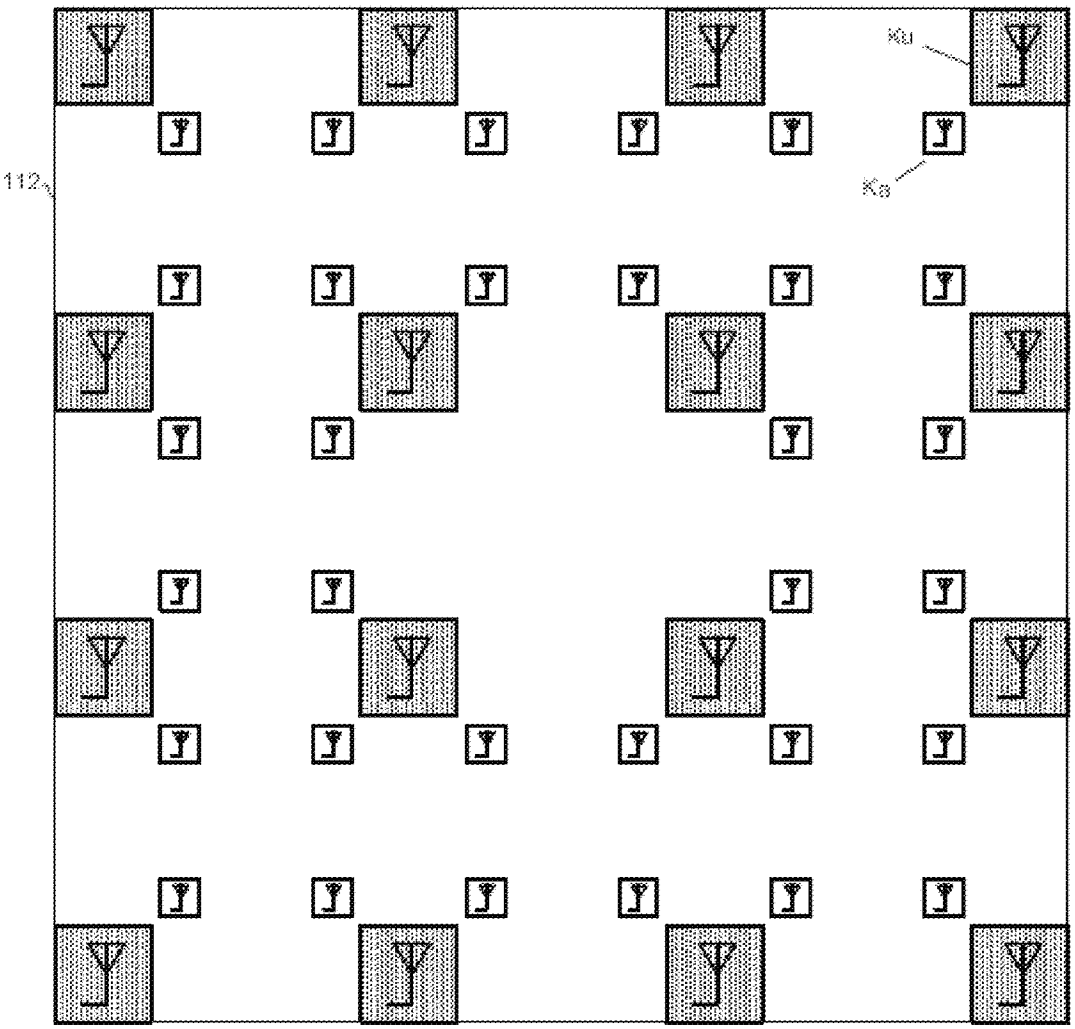
FIGS. 5D and 5E illustrate interleaving of elements of multiple antenna arrays to take advantage of the power density profile.
Figure 5E:
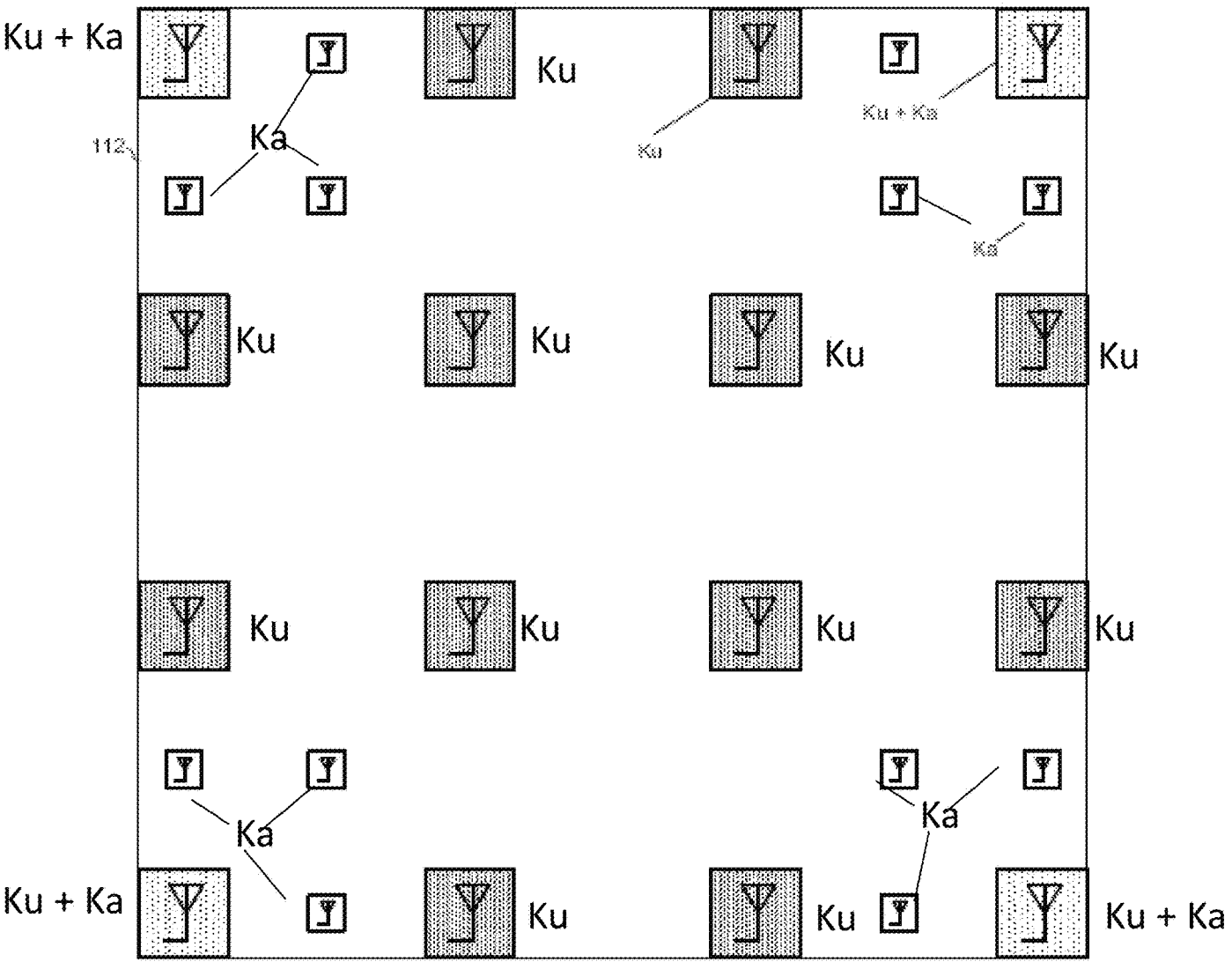

Expanding on this concept that element efficiency is less important near the edges, FIGS. 5D and 5E illustrate example arrays in which the second array (Ka band arrays in these examples) are interleaved with the first array (Ku band arrays in these examples) in less power dense areas (e.g., near the edges). In this regard, the interleaving of the two antenna arrays may result in coupling between the two arrays which may cause inter-beam interference, side lobes, and/or other artifacts. But, again, by limiting the second array to arrays where the first array is not driven with as much power, such artifacts are reduced.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled or not enabled (e.g., by a user-configurable setting, factory trim, etc.).

Accordingly, the present invention may be realized in hardware, software, or a combination of hardware and software. The present invention may be realized in a centralized fashion in at least one computing system, or in a distributed fashion where different elements are spread across several interconnected computing systems. Any kind of computing system or other apparatus adapted for carrying out the methods described herein is suited. A typical combination of hardware and software may be a general-purpose computing system with a program or other code that, when being loaded and executed, controls the computing system such that it carries out the methods described herein. Another typical implementation may comprise an application specific integrated circuit or chip. Other embodiments of the invention may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the processes as described herein.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. An array based communications system comprising:

a first plurality of element processors, each element processor of the first plurality of element processors being operable to communicate in a first communication band, each element processor of the first plurality of element processors being operably coupled to an antenna element in a first antenna array, wherein the first antenna array comprises one or more antenna elements having a first efficiency and one or more antenna elements having a second efficiency, and wherein the one or more antenna elements having the first efficiency are more efficient than the one or more antenna elements having the second efficiency, and wherein the one or more antenna elements having the first efficiency are located closer to a center of the first antenna array than the one or more antenna elements having the second efficiency; and a second plurality of element processors, each element processor of the second plurality of element processors being operable to communicate in a second communication band, each element processor of the second plurality of element processors being operably coupled to an antenna element in a second antenna array, one or more antenna elements of the second antenna array being positioned between antenna elements of the first antenna array.

2. The array based communications system of claim 1, wherein the first communication band is the Ku band and the second communication band is the Ka band.

3. The array based communications system of claim 1, wherein each antenna element of first antenna array and the second antenna array is a horn mounted to a printed circuit board with waveguide feed lines.

4. The array based communications system of claim 1, wherein at least one element processor of the first plurality of element processors is operably coupled to the same antenna element as at least one element processor of the second plurality of element processors.

5. The array based communications system of claim 1, wherein a third antenna array comprises the first antenna array and the second antenna array, the center of the third antenna array having a highest power density.

6. The array based communications system of claim 1, wherein each antenna element of the first antenna array is equally spaced over an area and each antenna element of the second antenna array is positioned away from the center of the area.

7. The array based communications system of claim 1, wherein the first antenna array comprises sixteen antenna elements that are equally spaced over an area and the second antenna array comprises sixteen antenna elements that are grouped into four groups of four antenna elements, each group of four antenna elements being located at a corresponding corner of the area, each group of four antenna elements being spaced closer together than the antenna elements of the first antenna array.

* * * * *